US005123272A

United States Patent [19]

Heaman

[11] Patent Number: 5,123,272

[45] Date of Patent: Jun. 23, 1992

[54] PIPE BENDING MACHINE FOR ELONGATE MATERIAL

[76] Inventor: Norman L. Heaman, 11 Meadow Crescent, Edmonton, Alberta, Canada, T6C 1G1

[21] Appl. No.: 769,081

[22] Filed: Sep. 30, 1991

[30] Foreign Application Priority Data

Sep. 6, 1991 [CA] Canada ..... 2050839

[51] Int. Cl.[5] ..... B21D 3/10

[52] U.S. Cl. ..... 72/389; 72/413; 72/20

[58] Field of Search ..... 72/389, 390, 413, 472, 72/477, 20

[56] References Cited

U.S. PATENT DOCUMENTS 1,118,046 11/1914 Poffinbarger ..... 72/413
1,156,062 10/1915 Crellin ..... 72/413
1,776,082 9/1930 Peterson ..... 72/413
4,987,760 1/1991 Schulte ..... 72/413

FOREIGN PATENT DOCUMENTS 0562718 6/1960 Belgium ..... 72/389
0159905 4/1905 Fed. Rep. of Germany ..... 72/413
0588582 2/1959 Italy ..... 72/389

*Primary Examiner*—David Jones
*Attorney, Agent, or Firm*—Davis, Bujold & Streck

[57] ABSTRACT

An improvement in a bending machine for elongate material consisting of a modified upper pressure member. The upper pressure member has a material contacting surface divided into a plurality of transverse segments which are movable to accommodate a bend in the material, such that the load required for the proper bending moment is distributed among all the segments.

8 Claims, 3 Drawing Sheets

PIPE BENDING MACHINE FOR ELONGATE MATERIAL

The present invention relates to a bending machine for elongate material.

BACKGROUND OF THE INVENTION

The present invention was developed expressly for large diameter pipe used for pipeline construction, but the principles are equally applicable to a variety of other elongate material. Large diameter pipe used for pipeline construction is frequently coated with styrene insulation. This insulation is intended to both maintain heat in fluids flowing through the completed pipeline and prevent environmental damage due to heat transference from the pipeline to the ground.

Pipe bending machines used for large diameter pipe are configured in the form of a huge press having two lower supports in spaced relation on which a pipe is supported. An upper pressure member is positioned above and between the two lower supports. A power source is used to cause relative movement of the lower supports and the upper pressure member such that the upper pressure member exerts a bending force upon the pipe.

With the current construction of pipe bending machine the bending force is concentrated at one or two points. Unfortunately, the force which must be exerted by to bend pipe 6 inches in diameter or larger, results in damage to the insulation, which must subsequently be repaired. The larger the diameter of pipe, the greater the bending force required and the more damage which is sustained by the insulation.

SUMMARY OF THE INVENTION

What is required is a bending machine for elongate material which is capable of bending the elongate material without concentrating the force at one or two points.

According to the present invention there is provided an improvement in a bending machine for elongate material. The improvement is comprised of a modification to the upper pressure member. The upper pressure member has a material contacting surface divided into a plurality of transverse segments which are movable to accommodate a bend in the material, such that the load required for the proper bending moment is distributed among all the segments.

With prior art bending machines the force exerted by the upper pressure member tended to become localized in one or two locations on the pipe. By having the upper pressure member divided into transverse segments which are movable to accommodate changes in the pipe as it bends, the force tends to be more evenly distributed.

Although beneficial results can be obtained through the use of the improved bending machine as described, even more beneficial results may be obtained through the use of hydraulic supports for each individual segment. The hydraulic supports for each individual segment are hydraulically linked with the hydraulic supports on all other segments such that a load exerted upon one segment is hydraulically distributed among all hydraulic supports for all segments.

Although beneficial results may be obtained through the use of the improved bending machine as described, even more beneficial results may be obtained when at least one of the lower supports also has a material contacting surface divided into a plurality of transverse segments which are movable to accommodate a bend in a pipe, such that the load required for the proper bending moment is distributed among all the segments.

Although beneficial results may be obtained through use of the improved bending machine as described, even more beneficial results may be obtained when the material contacting surface consists of a flexible membrane. The flexible membrane conforms to the cross-sectional shape and dimension of elongate material thereby permitting one size of material contacting surface to accommodate a variety of shapes and dimensional sizes of elongate material.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
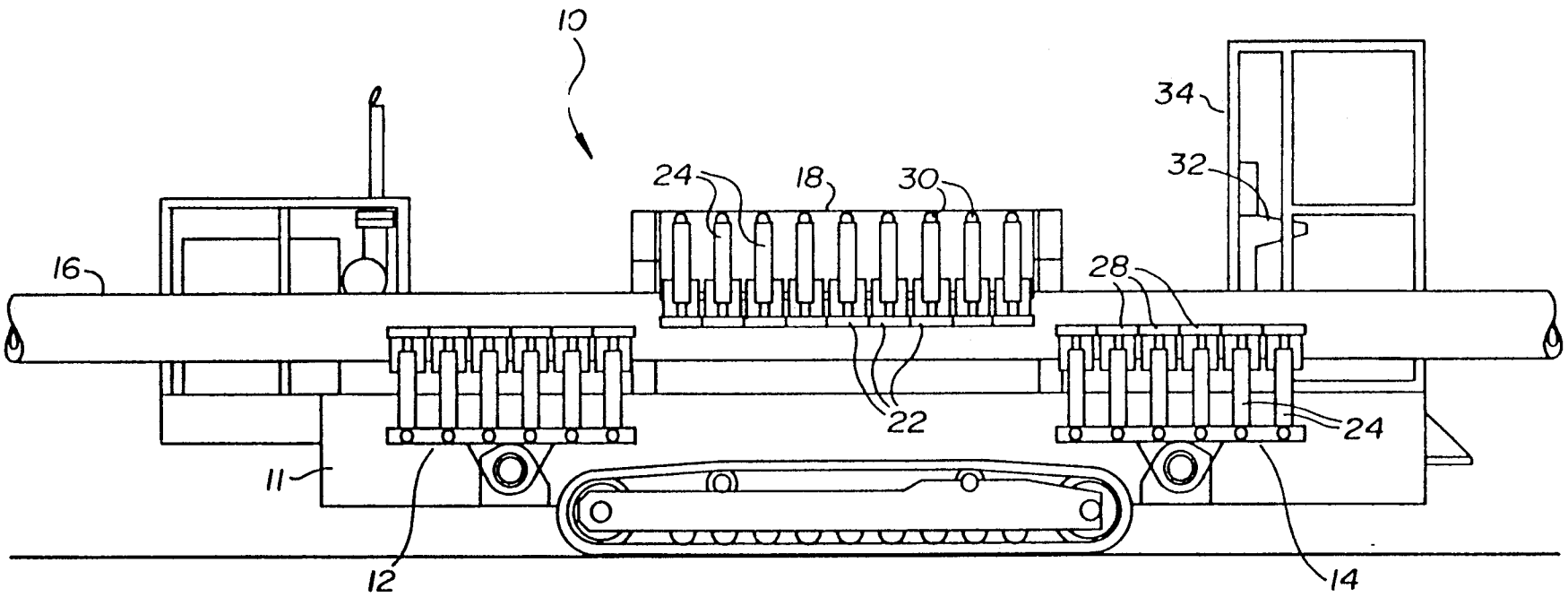
FIG. 1 is a side elevation view of a bending machine constructed in accordance with the teachings of the present invention, with a pipe in position to be bent.
Figure 2:
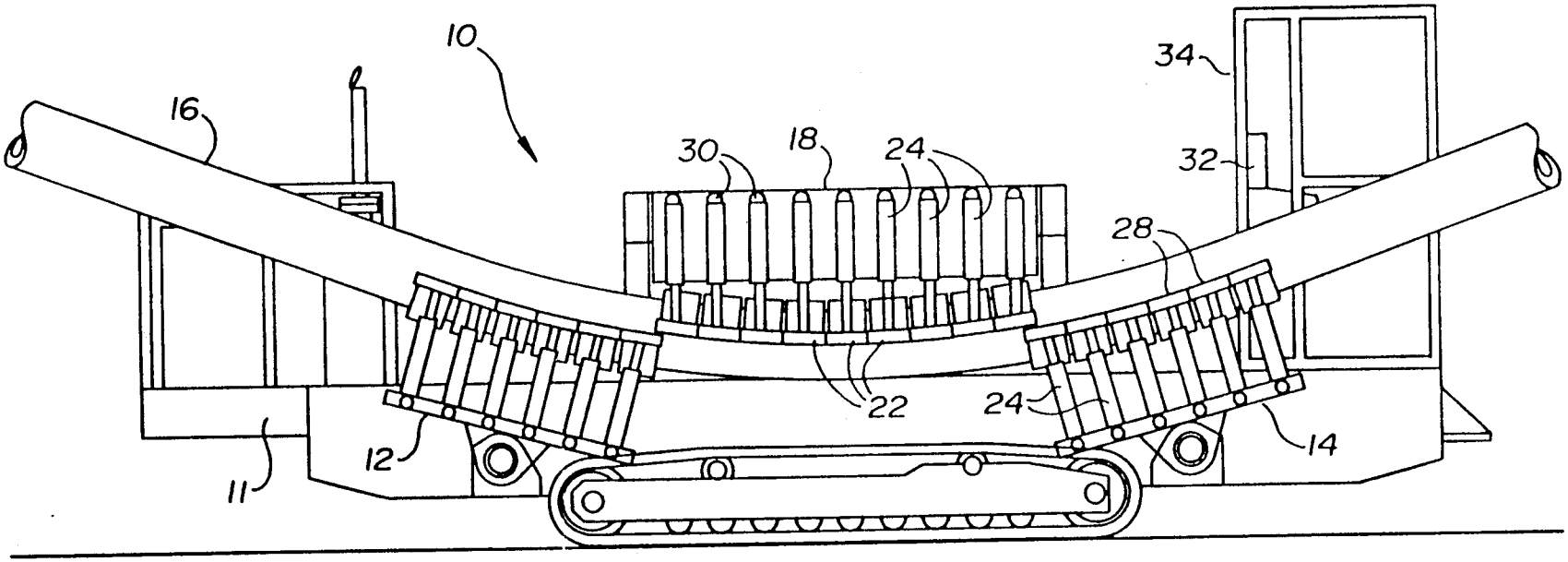
FIG. 2 is a side elevation view of a bending machine constructed in accordance with the teachings of the present invention, with, a pipe in the process of bending a pipe.
Figure 3:
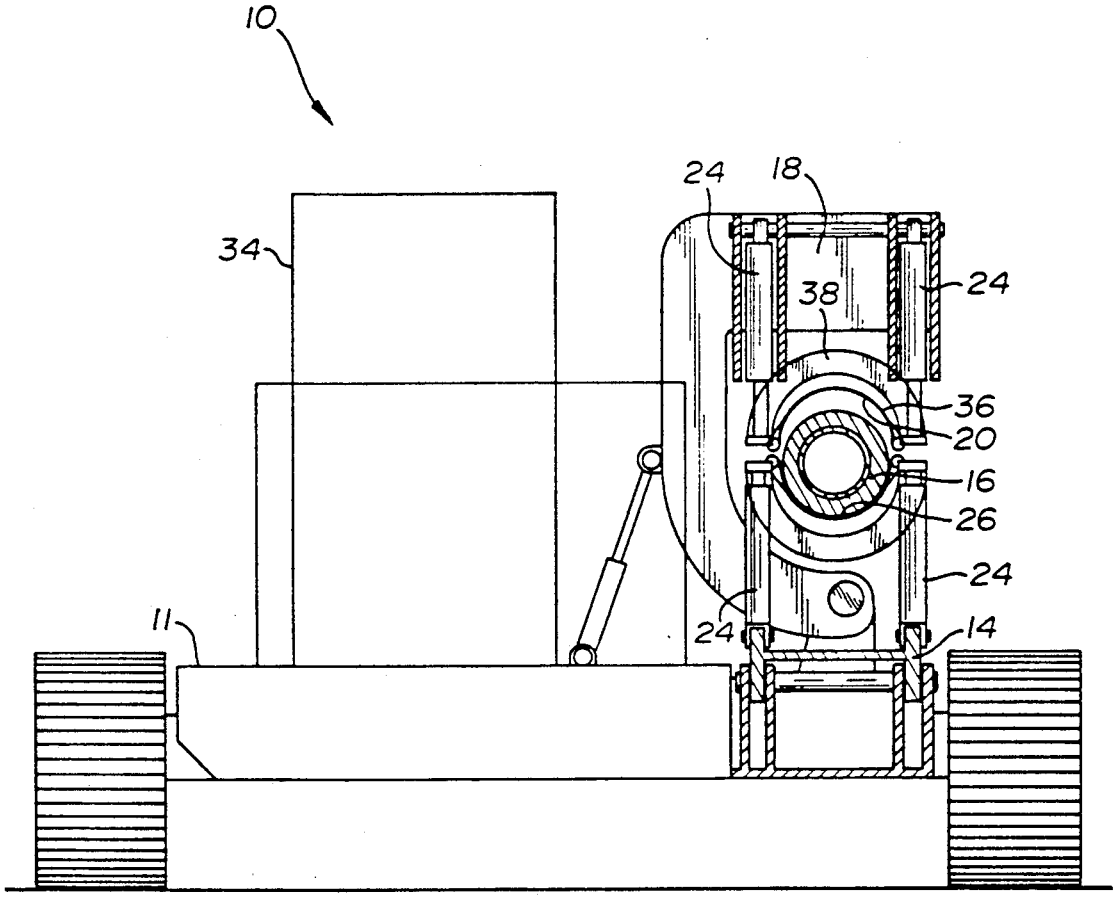
FIG. 3 is a transverse section view of the bending machine illustrated in FIG. 1.

The preferred embodiment, a bending machine for elongate material generally identified by reference numeral 10, will now be described with reference to FIGS. 1 through 3.

Those aspects of bending machine 10 which are similar to prior art pipe bending machines will first be described. The general configuration of bending machine 10 bears a resemblance to a large self propelled press. There are provided two lower supports, identified by reference numerals 12 and 14 respectively, secured to chassis 11 of bending machine 10 in spaced relation on which a pipe 16 is supported. An upper pressure member 18 is secured to chassis 11 which serves as a support frame and supports upper pressure member 18 in a position above and in axial alignment with lower supports 12 and 14. Relative movement of upper pressure member 18 and lower supports 12 and 14 exerts a bending force upon pipe 16.

The improvement which is claimed lies in a modification to upper pressure member 18. Upper pressure member 18, as modified, has a material contacting surface 20 which is divided into a plurality of transverse segments 22. As illustrated in FIG. 2, transverse segments 22 adjust to accommodate the curvature of pipe 16 as it is bent, such that the load required for the proper bending moment is distributed among all of segments 22. Hydraulic supports 24 are provided for each individual segment 22. Hydraulic supports 24 are hydraulically linked with hydraulic supports 24 on all other of segments 22 such that a load exerted upon one segment 22 is hydraulically distributed among all hydraulic supports 24 for all segments 22. Each hydraulic support 24 has a sensor 30 attached which senses the pressure in hydraulic support 24 and communicates the pressure reading to a computer 32 positioned at an operating station 34. It is preferred that lower supports 12 and 14 also have a material contacting surface 26 which is also divided into a plurality of transverse segments 28. A further improvement, made possible by the present invention is illustrated in FIG. 3. Material contacting surface 20 consisting of a flexible membrane 36 suspended in a frame 38, the purpose and benefits of which will hereinafter be further described.

The use and operation of pipe bending machine 10 will now be described with reference to FIGS. 1 through 3. With prior art bending machines only a portion of upper pressure member 18 remains in continuous contact with the curvature of pipe 16 during the bending process and consequently, the force exerted by upper pressure member 18 invariably becomes localized at one or two points on pipe 16. This being the case, insulation at the point of contact is invariably damaged. By way of example, styrene insulation is damaged by any force in excess of 75 pounds per square inch. If care is taken with prior art bending machines not to exceed a force of 75 pounds per square inch at any given point on pipe 16, the force exerted is insufficient to perform the task of bending the pipe. With the present invention the segments 22 conform to the curvature of pipe 16 distributing the load required for the proper bending moment among all of segments 22. The force required to accomplish the task of bending pipe 16 is provided by hydraulic supports 24. It is preferred that hydraulic supports 24 be hydraulically linked (not shown) to further enhances the distribution of force on upper pressure member 18. With hydraulic supports 24 hydraulically linked any excessive force which starts to build on one of segments 22 is hydraulically dispersed among all of segments 22. It is preferred that lower supports 12 and 14 also use segments 22, for the same reasons and also to improve the support provided.

The spreading of the force exerted by upper pressure member 18 through the use of segments 22, provides further advantages. With prior art bending machines different sizes of rigid upper pressure members 18 and rigid lower supports 12 and 14 are required for differing diameters of pipe. With the present invention, upper pressure member 18 and lower supports 12 and 14 need not withstand the same forces. Flexible membrane 36 has sufficient strength to withstand the forces exerted by upper pressure member 18, and provides the advantage of conforming to the diameter of pipe 16, permitting one size of contacting surface 20 to accommodate a variety of diameters of pipe 16. Flexible membrane 36 can be made of a variety of materials; a nylon sling material is preferred. The use of sensors 30 and a computer 32 permits an operator at operating station 34 to monitor the force being exerted, and adjust that force as required.

It will be apparent to one skilled in the art that, depending upon the application, it may be desirable to have some of segments 22 exerting a greater force than other of segments 22. This may be accomplished in two alternative ways. One alternative is to provide means for direct control of the individual hydraulic supports 24 for each individual segment 22 through sensors 30 and computer 34. A second alternative is to vary the sizes of segments 22 and varying the sizes of hydraulic supports 24, so that although the pressure exerted is hydraulically dispersed among all of segments 22, the resulting pressure is not equal.

It will be apparent to one skilled in the art that the flexible membrane provides some side support which reduces the amount of "egging" distortion of pipe during the bending moment. This makes internal reinforcing mandrels unnecessary with some types of pipe.

Although the example illustrated is that of a pipe, it will be apparent to one skilled in the art that the flexible membrane can conform to the cross-sectional shape and dimension of any elongate material thereby permitting one size of material contacting surface to accommodate a variety of shapes and dimensional sizes of elongate material.

It will be apparent to one skilled in the art that modifications may be made to the preferred embodiment without departing from the spirit and scope of the invention as defined by the claims.

The embodiments of the invention in which an exclusive property or privilege is claimed are defined as follows:

1. An improvement in a bending machine for elongate material consisting of two lower supports in axially spaced relation on which material is supported and an upper pressure member secured to a support frame and above and in axial alignment with the two lower supports, at least one of the lower supports and upper pressure member being movable, means being provided to cause relative movement of the lower supports and upper pressure member such that the upper pressure member exerts a bending force upon the material, the improvement being characterized by:

a pressure member having a material contacting surface divided into a plurality of transverse segments which are movable during the bending process to accommodate a bend in the material, each individual segment having hydraulic supports, the hydraulic supports for each individual segment being hydraulically linked with the hydraulic supports on all other segments such that a load exerted hydraulic supports on all other segments such that a load exerted upon one segment is hydraulically distributed among the hydraulic supports for all segments thereby distributing the load required for the proper bending moment among all the segments.

2. An improvement in a bending machine for elongate material consisting of two lower supports in axially spaced relation on which material is supported and an upper pressure member secured to a support frame and above and in axial alignment with the two lower supports, at least one of the lower supports and upper pressure member being movable, means being provided to cause relative movement of the lower supports and upper pressure member such that the upper pressure member exerts a bending force upon the material, the improvement being characterized by:

a pressure member having a material contacting surface divided into a plurality of transverse segments which are movable during the bending process to accommodate a bend in the material, each individual segment having hydraulic supports, each of the hydraulic supports having sensors which monitor the pressure in the hydraulic supports, the sensors being linked to a computer which monitors the force exerted such that the load required for the proper bending moment is distributed among all the segments.

3. An improvement in a bending machine for elongate material consisting of two lower supports in axially spaced relation on which material is supported and an upper pressure member secured to a support frame and above and in axial alignment with the two lower supports, at least one of the lower supports and upper pressure member being movable, means being provided to cause relative movement of the lower supports and upper pressure member such that the upper pressure member exerts a bending force upon the material, the improvement being characterized by:

a pressure member having a material contacting surface divided into a plurality of transverse segments which are movable during the bending process to accommodate a bend in the material, means for distributing the load among the segments, such that the load required for the proper bending moment is distributed among all the segments, at least one of the lower supports having a material contacting surface divided into a plurality of transverse segments which are movable during the bending process to accommodate a bend in a pipe.

4. An improvement in a bending machine for elongate material consisting of two lower suppers in axially spaced relation on which material is supported and an upper pressure member secured to a support frame and above and in axial alignment with the two lower supports, at least one of the lower supports and upper pressure member being movable, means being provided to cause relative movement of the lower supports and upper pressure member such that the upper pressure member exerts a bending force upon the material, the improvement being characterized by:

a pressure member having a material contacting surface divided into a plurality of transverse segments which are movable during the bending process to accommodate a bend in the material, means being provided to distribute the load among the segments such that the load required for the proper bending moment is distributed among all the segments, the material contacting surface consisting of a flexible membrane suspended in a frame, such that the flexible membrane conforms to the cross-sectional shape and dimension of elongate material thereby permitting one size of material contacting surface to accommodate a variety of shapes and dimensionable sizes of elongate material.

5. An improvement in a bending machine for elongate material consisting of two lower suppers in axially spaced relation on which material is supported and an upper pressure member secured to a support frame and above and in axial alignment with the two lower supports, at least one of the lower supports and upper pressure member being movable, means being provided to cause relative movement of the lower supports and upper pressure member such that the upper pressure member exerts a bending force upon the material, the improvement being characterized by:

a pressure member having a material contacting surface divided into a plurality of transverse segments which are movable during the bending process to accommodate a bend in the material, each individual segment having hydraulic supports, the hydraulic supports for each individual segment being hydraulically linked with the hydraulic supports on all other segments such that a load exerted upon one segment is hydraulically distributed among the hydraulic supports for all segments thereby distributing the load required for the proper bending moment among all the segments; and the lower supports having a material contact surface divided into a plurality of transverse segments which are movable during the bending process to accommodate a bend in a pipe.

6. The improvement as defined in claim 5, the material contacting surface consisting of a flexible membrane suspended in a frame, such that the flexible membrane conforms to the cross-sectional shape and dimension of elongate material thereby permitting one size of material contacting surface to accommodate a variety of shapes and dimensional sizes of elongate material.

7. An improvement in a bending machine for elongate material consisting of two lower suppers in axially spaced relation on which material is supported and an upper pressure member secured to a support frame and above and in axial alignment with the two lower supports, at least one of the lower supports and upper pressure member being movable, means being provided to cause relative movement of the lower supports and upper pressure member such that the upper pressure member exerts a bending force upon the material, the improvement being characterized by:

a pressure member having a material contacting surface divided into a plurality of transverse segments which are movable during the bending process to accommodate a bend in the material, each individual segment having hydraulic supports, each of the hydraulic supports having sensors which monitor the pressure in the hydraulic supports, the sensors being linked to a computer which monitors the force exerted such that the load required for the proper bending moment is distributed among all the segments; and the lower supports having a material contact surface divided into a plurality of transverse segments which are movable during the bending process to accommodate a bend in a pipe.

8. The improvement as defined in claim 7, the material contacting surface consisting of a flexible membrane suspended in a frame, such that the flexible membrane conforms to the cross-sectional shape and dimension of elongate material thereby permitting one size of material contacting surface to accommodate a variety of shapes and dimensional sizes of elongate material.

* * * * *

UNITED STATES PATENT AND TRADEMARK OFFICE

CERTIFICATE OF CORRECTION

PATENT NO. : 5,123,272

DATED : June 23, 1992

INVENTOR(S) : Norman L. HEAMAN

It is certified that error appears in the above-identified patent and that said Letters Patent is hereby corrected as shown below:

Column 5, line 40 change "dimensionable" to --dimensional--.

Column 6, line 22 change "suppers" to --supports--.

Signed and Sealed this

Twentieth Day of July, 1993

*Attest:*

Michael K. Kirk

MICHAEL K. KIRK

*Attesting Officer*

*Acting Commissioner of Patents and Trademarks*